US005881704A

United States Patent [19]

Andrews

[11] Patent Number: 5,881,704

[45] Date of Patent: Mar. 16, 1999

[54] ARCHERY BOW LIMB AND METHOD

[75] Inventor: Albert A. Andrews, Hixson, Tenn.

[73] Assignee: High Country Archery, Inc., Dunlap, Tenn.

[21] Appl. No.: 840,873

[22] Filed: Apr. 17, 1997

[51] Int. Cl.[6] ..... F41B 5/00

[52] U.S. Cl. ..... 124/23.1; 124/86

[58] Field of Search ..... 124/23.1, 86, 88; 156/84, 85, 309.6; 264/230, 261, 342 R

[56] References Cited

U.S. PATENT DOCUMENTS

| | | | |
|---|---|---|---|
| 2,613,660 | 10/1952 | Bear | 124/23.1 |
| 2,815,015 | 12/1957 | DeGiacomo | 124/23.1 |
| 2,818,057 | 12/1957 | Meyer et al. | 124/23.1 |
| 2,894,503 | 7/1959 | Pierson et al. | 124/23.1 |
| 2,945,488 | 7/1960 | Cravotta et al. | 124/23.1 |
| 3,167,063 | 1/1965 | Kappas | 124/23.1 |
| 3,533,864 | 10/1970 | Ianuzzi et al. | 156/85 X |
| 4,836,872 | 6/1989 | Landry et al. | 156/85 |
| 5,009,730 | 4/1991 | Tozier | 156/85 |
| 5,657,739 | 8/1997 | Smith | 124/23.1 |

*Primary Examiner*—John A. Ricci
*Attorney, Agent, or Firm*—Barnes, Kisselle, Raisch, Choate, Whittemore & Hulbert, P.C.

[57] ABSTRACT

A composite reinforced limb of an archery bow is at least partially covered with a dry film of a polymeric coating initially applied in a generally liquid mixture adjacent to and firmly engaging at least a portion of the limb to prevent the underlying composite layers or fibers of the limb from becoming noticeably detached from the limb, to reinforce the limb and to reduce vibration and noise of the bow during use. Preferably, a substantial portion of the periphery of the limb is covered by the polymeric coating which is preferably sprayed on to the limb with a spray applicator. Preferably, the spray applicator is automated and several limbs are coated in an assembly line fashion by the spray applicator. Alternatively, the polymeric coating can be brushed on or the limb can be dipped into a supply of the coating material to cover at least that portion of the limb. The polymeric coating dries to a film in generally solid but pliable state and does not effect the draw length or draw weight of the bow in use.

13 Claims, 1 Drawing Sheet

ARCHERY BOW LIMB AND METHOD

FIELD OF THE INVENTION

This invention relates to archery bows and more particularly to a limb of an archery bow and a method of making it.

BACKGROUND OF THE INVENTION

Archery bows have resilient limbs made of various materials such as wood, various metals and various composite materials. Additionally, composite materials such as fiberglass or the like can also be layered about the limb to provide reinforcement and stability to the limb. Typically, the composite reinforcements are applied to the limb in thin layers adhered by a resin to the surface of the limb. It is difficult to consistently and permanently adhere all of the composite material to the limb and, during use, some of the fibers or a portion of the underlying layers of the composite material become detached from the limb of the bow and create a cosmetic blemish noticeable on the exterior of the limb and unacceptable to the user.

SUMMARY OF THE INVENTION

A composite reinforced limb of an archery bow is at least partially covered with a polymeric coating initially applied in a generally liquid mixture adjacent to and firmly engaging at least a portion of the limb to prevent the underlying composite layers or fibers adjacent the limb from becoming noticeably detached from the limb, to reinforce the limb and to reduce vibration and noise of the bow during use. Preferably, a substantial portion of the periphery of the limb is covered by a polymeric coating which is sprayed on to the limb with a spray applicator. Preferably, the spray applicator is automated and several limbs are coated in an assembly line fashion by the spray applicator. Alternatively, the polymeric coating can be brushed on or the limb can be dipped into a supply of the coating material or the coating material can be molded onto the limb such as by an injection molding process or the like. The polymeric coating dries to a generally solid but pliable state and does not effect the draw length or draw weight of the bow in use.

Covering the limb with the polymeric material substantially eliminates the problem of inconsistent or incomplete attachment of the fibers of the composite reinforcements to the body of the limb. In addition, the resilient and polymeric material of the coating dampens the vibrations which occur within the limb during use of the bow. Further, the polymeric coating provides a factor of safety if the bow fails during use, such as when the limb of the bow cracks, splinters or otherwise breaks by providing an extra layer of material adjacent to the limb which tends to confine any fibers, splinters or ruptures of the limb material.

Objects, features and advantages of this invention, include providing an archery bow having composite reinforced limbs having at least a portion of the limbs covered with at least one layer of a polymeric coating to reduce the problem of the fibers of the composite reinforcement splintering or becoming detached from the limb, dampens vibrations within the limb, reduces noise of the bow during its use, provides added safety to the user of the bow when the limb of the bow cracks or otherwise breaks, increases the rate at which an arrow is released from the bow, minimizes wear on the bow, reduces stresses in the bow in use, reduces the magnitude of the vibrations experienced by the user, is somewhat resistant to scratches and cuts, and is of relatively simple design and economical manufacture and has a long in-service useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
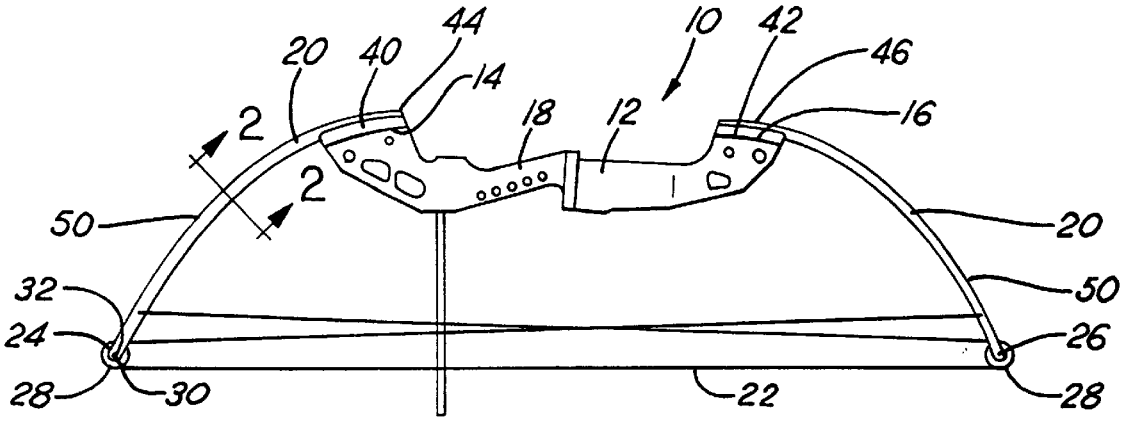
FIG. 1 is a perspective view of a compound bow embodying this invention.

Referring in more detail to the drawings, FIG. 1 shows an archery bow 10 having a riser 12 with opposed ends 14, 16, a handle portion 18 of the riser 12, a limb 20 cantilevered and extending from each end 14, 16 of the riser 12, and a bowstring 22 attached between the free end 24, 26 of each limb 20. This type of bow 10 is typically referred to as a compound bow and preferably has a cam 28 disposed adjacent the free ends 24, 26 of each limb 20 about an axle 30 received in an axle hole 32 through the limb 20 with the bowstring 22 wound about each cam 28. The cams 28 are preferably complementarily shaped and the bowstring 22 is wound about the cams 28 in such a way that displacement of the bowstring 22 causes substantially equal deflection of each of the limbs 20 thereby storing substantially equal amounts of potential energy within each limb 20 when deflected. Preferably, to facilitate pulling the drawstring 22 and deflecting the limbs 20, the cams 28 have a profile which varies the draw weight of the bow 10 as a function of the draw length. Preferably the maximum draw weight is achieved somewhat before maximum draw and decreases somewhat at full draw length.

The riser 12 of the bow 10 is made of a relatively stiff material, such as various woods, metals and composite materials, and is resistant to bending to provide a stable body for the archer to hold while using the bow 10. The handle portion 18 is preferably ergonomically designed to fit within the archers hand at a location providing balance while both holding the bow 10 and while pulling the bowstring 22. Each end 14, 16 of the riser 12 has a generally flat face 40, 42 inclined at an acute included angle relative to the longitudinal axis of the riser 12 providing a mounting surface for an end 44, 46 of a limb 20.

The limbs 20 of the bow 10 are made of a highly resilient material and are generally thin and elongate so that they may be relatively easily flexed. The limbs 20 are cantilevered adjacent each end 14, 16 of the riser 12 and are preferably generally arcuate or slightly curved. The limbs 20 can be made from various materials such as wood, metal and composite materials. Preferably, the limbs 20 are reinforced with a composite material 48 adhered to the limbs 20 with a resin. Also preferably, the composite reinforcement 48 comprises thin layers of fiberglass roving or fibers embedded in a resin firmly adhered to the limbs 20.

Figure 2:
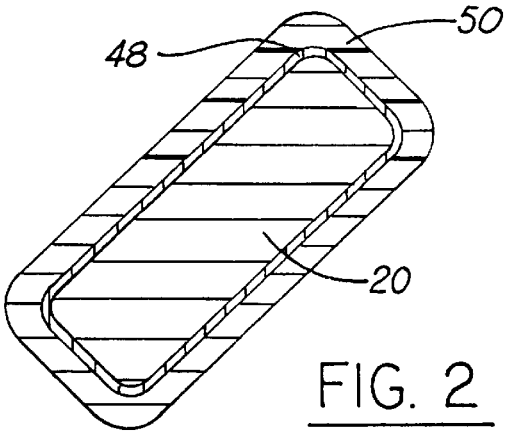
FIG. 2 is a sectional view of a limb of the bow taken through a portion of the limb covered with a polymeric coating.

According to the present invention, as shown in FIG. 2, the periphery of the limbs 20 are at least partially covered with a polymeric coating 50 initially applied to the limbs 20 in a generally liquid mixture. The coating 50 preferably covers substantially the entire periphery of a portion of the limb 20, and particularly adjacent the free end 24, 26 of each limb 20, and more preferably, the coating 50 substantially covers the entire limb 20.

Figure 4:
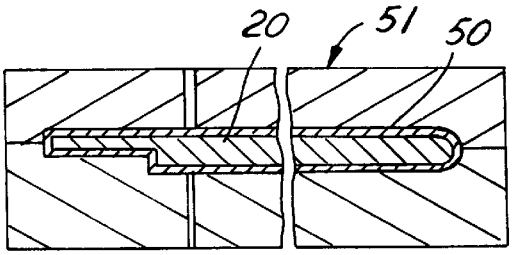
FIG. 4 is a sectional view of a limb within a mold cavity wherein a polymeric material is molded onto the limb.

The coating 50 is a flexible and somewhat resilient polymeric material applied to the limbs 20 in a liquid mixture which preferably has various solvents to aid in the application of the mixture to the limb 20 and various resins to adhere the coating 50 to the limb 20. Preferably, the liquid mixture is sprayed through a spray applicator onto the limbs 20 and more preferably, the spraying process is automated whereby several limbs 20 can be coated in an assembly line fashion to increase the efficiency of applying the coating 50. Alternatively, the polymeric coating 50 can be brushed onto the limb 20 or the limb 20 can be dipped into a supply of the liquid mixture containing the coating material to cover at least that portion of the limb 20. Another alternate method for applying the polymeric coating 50 is by molding it onto a limb 20 within a molding apparatus 51 as shown in FIG. 4 such as by an injection molding process or the like.

However applied, the coating 50 dries or is cured to a generally solid state but is pliable such that it does not effect the draw length or draw weight of the bow 10 in use and can readily flex without cracking or buckling during use of the bow 10. The thickness of the coating 50 is at least about 0.005 inches and normally between 0.005 inches to 0.10 inches and preferably between 0.01 inches to 0.05 inches. Preferably, several layers of the liquid mixture containing the coating material are applied to the limb 20 such that the total thickness of the layers is at least 0.005 inches.

The polymeric coating 50 can comprise any thermoplastic, thermoset or elastomeric material having sufficient flexibility and resilience to withstand the numerous deflections of the limbs 20 without cracking, buckling or otherwise failing throughout the life of the bow 10. Representative materials include silicone rubber, nitrile rubber, butadiene-styrene rubber, polychloroprene, polyisoprene, butadiene-acrylonitrile, carbon or glass graphite composites, nylon, vinyl plastisols such as urethane and polyurethane elastomer and alumina ceramics.

A currently preferred polymeric coating material is commercially available from P.D.I., Inc., under the trade name Plasti Dip. Plasti Dip is a thermoplastic material which cures at room temperature to a synthetic, rubber-like finish that exhibits excellent moisture, acids, alkalines, abrasion and dielectric resistance. This material in liquid form is made up of 24% solids and has a tensile strength of about 3,000 psi with an elongation of approximately 500%. A second presently preferred material for the coating 50 is sold by Valvoline Industrial Coatings, a division of Ash Land Inc., under the trade name TECTYL®. TECTYL® is sold in several different formulations such as TECTYL® 2410 and TECTYL® 2118 and is a high solids content coating which, when cured, provides a film which is relatively hard but flexible.

Figure 5:
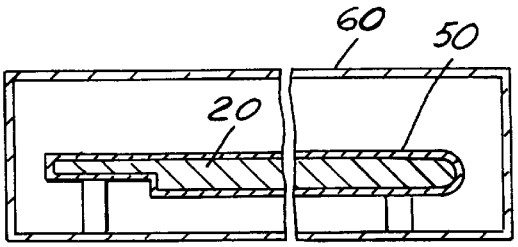
FIG. 5 is a sectional view a limb within an oven to bake or cure a polymeric coating onto the limb.
Figure 3:
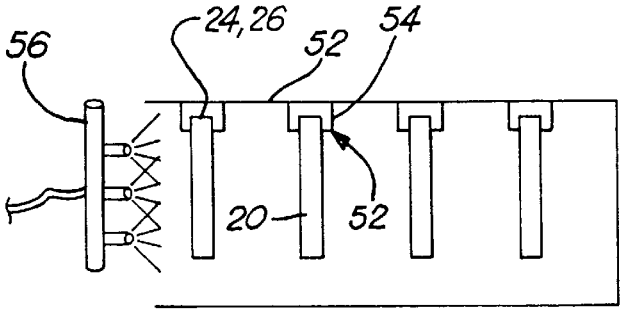
FIG. 3 is a perspective view of a spray applicator system applying the polymeric coating to several compound bow limbs.

As shown in FIG. 3, each limb 20 is preferably carried on a rack 52 with a pin 54 through the axle hole 32 adjacent the free end 24, 26 of the limb 20. An automated spray applicator 56 applies the polymeric coating 50 to the limbs 20 in a liquid mixture which is dried or cured, preferably at room temperature, to form a rubber-like film at least 0.005 inches thick and preferably covering the entire periphery of at least a portion of the limb 20. More preferably, the polymeric coating 50 covers the periphery of substantially the entire length of the limb 20. Optionally, as shown in FIG. 5, after the limbs 20 are sprayed or otherwise coated with the liquid mixture containing the coating 50 material, the limbs 20 can be placed into an oven 60 to cure the liquid mixture and adhere the coating 50 to the limb 20.

In use, the polymeric coating 50 adhered to the limbs 20 of the bow 10 helps to prevent the fibers of the composite reinforcements 48 of the limbs 20 from splintering or becoming noticeably detached from the limb 20. The resilient and pliable qualities of the polymeric coating material also reduce vibration of the limb 20 during use which increases the performance of the bow 10 and has the effect of increasing the speed obtained by an arrow shot from the bow 10 by about 1 to 2 feet per second or more. The reduced vibration also reduces the noise of the bow 10 during use. In addition, the polymeric coating 50 adjacent to the limbs 20 provides an added safety factor as the material of the coating 50 tends to contain any cracked or broken pieces of the limbs 20 thereby reducing the likelihood of injury to the archer. Thus, the coated limbs 20 substantially prevent the fibers of the composite reinforcement 48 of the limbs 20 from splintering or becoming detached from the limbs 20 and also improves the performance and safety of the bow 10 in use.

I claim:

1. A limb for an archery bow comprising:

an elongate body formed from a resilient material and having a composite material of resin and at least one of roving and fibers embedded therein with the composite material providing an exterior surface of the elongate body, and a polymeric dry film directly overlying and intimately adhered to the exterior surface of the composite material and applied as a liquid mixture covering at least a portion of the composite material of the elongate body of the limb and cured to a dry film.

2. The limb of claim 1 wherein the polymeric film is generally solid and pliable.

3. The limb of claim 1 wherein the polymeric film substantially, completely covers the periphery of at least a portion of the body of the limb.

4. The limb of claim 3 wherein the polymeric film covers substantially the entire body of the limb.

5. The limb of claim 1 wherein the polymeric film is of a thermoplastic material.

6. The limb of claim 1 wherein the polymeric film is about between 0.005 inches to 0.10 inches thick.

7. The limb of claim 6 wherein the polymeric film comprises several layers of polymeric film each applied as a liquid mixture and after curing to a dry film has a total thickness of at least 0.005 inches.

8. The limb of claim 1 wherein the liquid mixture was sprayed onto the body of the limb with a spray applicator and cured to a dry film.

9. The limb of claim 1 wherein the liquid mixture was brushed onto the body of the limb and cured to a dry film.

10. The limb of claim 1 wherein the body of the limb is at least partially inserted into a container of the liquid mixture to at least partially coat that portion of the body of the limb.

11. The limb of claim 1 wherein the polymeric film is a thermoset material.

12. The limb of claim 1 wherein the polymeric film is an elastomeric material.

13. The limb of claim 1 wherein the limb is placed in an oven at an elevated temperature to cure the polymeric liquid mixture to a dry film and adhere it to the limb.

* * * * *